United States Patent [19]

Chiroff

[11] 4,407,079

[45] Oct. 4, 1983

[54] GOLF AID DEVICE

[76] Inventor: Lee M. Chiroff, 8027 S. 56th St., Franklin, Wis. 53132

[21] Appl. No.: 269,407

[22] Filed: Jun. 4, 1981

[51] Int. Cl.[3] ..... A63B 69/36; A43B 5/00

[52] U.S. Cl. ..... 36/127; 36/132; 273/187 B

[58] Field of Search ..... 273/187 B, 32 C, DIG. 18, 273/188 A; 36/127, 134, 132, 136, 139

[56] References Cited

U.S. PATENT DOCUMENTS

| | | | |
|---|---|---|---|
| 2,095,095 | 10/1937 | Howard | 36/127 X |
| 2,519,613 | 8/1950 | Urban | 273/187 B X |
| 3,218,734 | 11/1965 | O'Brien | 273/32 C |
| 4,122,577 | 10/1978 | Catania | 36/127 X |
| 4,145,055 | 3/1979 | O'Brien | 273/187 B |

*Primary Examiner*—George J. Marlo

*Attorney, Agent, or Firm*—Andrus, Sceales, Starke & Sawall

[57] ABSTRACT

A golf aid device comprises an attachment to be secured to the shoe of the golfer to be worn on the foot that will assume the stance position closest to the target when addressing the ball for a fairway or tee shot. The attachment is disposed beneath the sole of the shoe and along the outside edge thereof. The attachment includes a pair of linkage members and an elongated member having an arcuate surface that slopes toward the outside edge of the sole and upon which the golfer can pivot following an impact with the ball and during the subsequent follow-through of the golf swing. One end of each linkage member is slotted to provide an adjustable connection to the conventional spikes on the shoe. The other end of each linkage member is pivotally connected to the elongated member.

2 Claims, 4 Drawing Figures

FIG.1
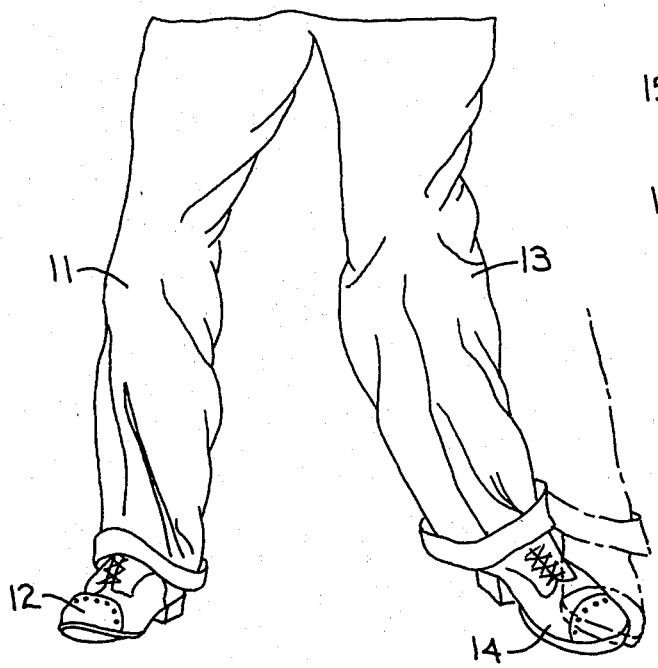
FIG.2
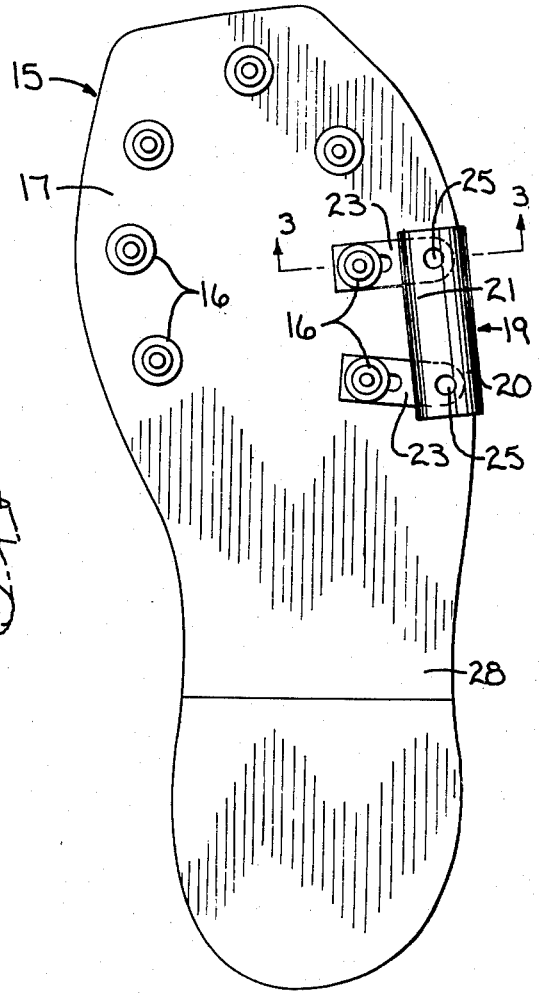
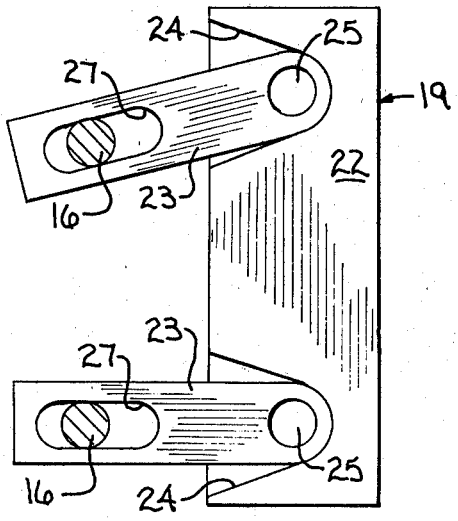
FIG.4
FIG.3
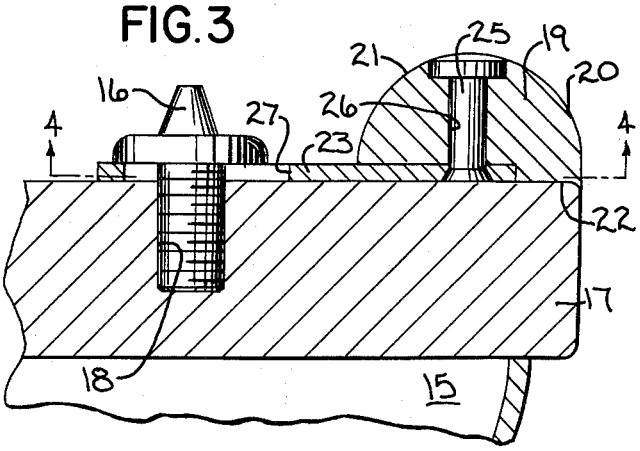

GOLF AID DEVICE

BACKGROUND OF THE INVENTION

This invention relates to a golf aid device, and more specifically to an attachment for the shoe of the golfer designed to help the golfer with his or her stance and foot action when addressing and/or hitting a fairway or tee shot.

Many golfers and particularly beginners at the game of golf remain generally "flat-footed" when addressing and/or hitting a fairway or tee shot. As a consequence, they look and feel awkward and uncomfortable and frequently lose their balance during the swing. When the ball is struck under those conditions, the impact will be at generally less than maximum power and the direction of the ball is at best unpredictable. It is generally an object of this invention to provide golf shoes and/or an attachment therefor which is likely to aid a golfer with his or her stance and foot action when addressing and/or hitting a fairway or tee shot with the expected result that greater distance is likely to be achieved when desired and also greater accuracy.

SUMMARY OF THE INVENTION

Broadly, the invention contemplates a device for aiding a golfer with fairway and tee shots. The device takes the form of an attachment for securement to the shoe of the golfer to be worn on the foot that will assume the position closest to the target when addressing the ball. The attachment is disposed beneath the sole of the shoe and along the outside edge thereof. The attachment includes an arcuate surface that slopes toward the outside edge of the sole and upon which the golfer can pivot following an impact with the ball and during the subsequent follow-through of the golfer's swing.

DESCRIPTION OF THE DRAWING FIGURES

The drawings furnished herewith illustrate the best mode presently contemplated for carrying out the invention and are described hereinafter.

In the drawings

FIG. 1 shows the legs and feet of a golfer in a generally proper stance or position when the golf club reaches the top of the back swing and is ready to commence the impact stroke of a fairway or tee shot, and in phantom lines shows the leg and foot closest to the target after having made contact with the ball and during the follow-through portion of the golf stroke;

FIG. 2 is a bottom plan view of a golf shoe equipped with the attachment of this invention;

FIG. 3 is an enlarged detail view taken generally on line 3—3 of FIG. 2; and

FIG. 4 is a detail view taken generally on line 4—4 of FIG. 3.

DESCRIPTION OF THE ILLUSTRATED EMBODIMENT

Referring to the drawings, FIG. 1 generally shows a golfer's proper stance or position at the instant when the golf club is at the top of the back swing and ready to commence the impact stroke of a fairway or tee shot. At the instant depicted, leg 11 farthest from the target is generally straight with the corresponding foot 12 firmly planted on the ground and carrying the greater share of the golfer's weight. Simultaneously, the leg 13 nearest to the target carries the lesser share of the golfer's weight and is flexed at the knee inwardly toward the leg 11 with the foot 14 pivoted correspondingly so that the weight carried by the leg 13 is generally distributed along the inside edge of the foot 14. During the swing to impact with the ball, not shown, and which is to move toward the right in FIG. 1, substantial weight is transferred from the leg 11 to the leg 13 with the weight distribution at the time of impact being substantially equal between the legs. Also during the swing to impact with the ball, the flexed leg 13 generally straightens out as weight is transferred thereto at the time of impact. Following the impact with the ball, the momentum of the body ordinarily effects a pivoting of the foot 14 toward the target as generally shown in phantom lines in FIG. 1 transferring the weight carried by the leg 13 to the outside edge of foot 14 to provide for a generally smooth and complete follow-through.

According to my observation, numerous golfers and particularly beginners could markedly improve their game with assistance to their stance and foot action when making fairway and tee shots. It is my belief that if the stance and action of the foot closest to the target, the left foot for right handed golfers and the right foot for left handed golfers, were improved with the golf aid of this invention, better scores likely would result.

The invention contemplates use of conventional golf shoes 15 having a plurality of spikes 16 projecting from the soles 17 thereof. The spikes 16 are threadedly engaged within holes 18 that are generally arranged in a pattern that follows and is spaced from the outer edge of the sole.

The golf aid of this invention comprises a shoe attachment which is secured in place by selected spikes 16 beneath the sole 17 and adjacent to the top edge thereof along the outside edge of the shoe 15 worn on the foot of the golfer which will be placed closest to the target. The attachment generally comprises a roll bar 19 which, when secured in place, extends generally longitudinally relative to the shoe 15 and provides an arcuate pivoting surface 20 along the outside edge of the shoe.

As viewed in section, the roll bar 19 is shown to have an arcuate ground engaging surface 21 of which the pivoting surface 20 forms a part. As shown in FIG. 3, a generally flat sole engaging surface 22 subtends the arcuate surface 21 of the roll bar.

The roll bar 19 is secured in place by the spikes 16 through a pair of longitudinally spaced connecting links 23. To accommodate one end of the links 23, the roll bar 19 is provided with a pair of longitudinally spaced recesses 24 that interrupt the flat surface 22 and open inwardly toward the adjacent spikes 16. The connecting links 23 are pivotally secured in the corresponding recesses 24 by the rivets 25 or other pin means seated in the spaced vertical holes 26 generally centrally of the roll bar 19 and extending through the link members. The holes 26 are countersunk so that the heads of the rivets 25 or other pin means will not project beyond the arcuate pivoting surface 20 of the roll bar. The pivoting linkage members 23 are adapted to accommodate spacing variations between spikes 16 as are likely presented on different shoes.

To accommodate spacing variations between the spikes 16 and the edge of the sole 17, the connecting links 23 are provided with an elongated slot 27 extending longitudinally of the link members remote from the roll bar 19. With the roll bar 19 positioned to place the end or edge of pivoting surface 20 in general alignment with the edge of the sole 17, the linkage members 23 are pivoted to align the slots 27 with the corresponding threaded holes 18. The spikes 16 are then threaded into the holes 18 to secure the roll bar 29 in place. While ordinarily the roll bar 19 is secured in place by the first two spikes 16 as counted from the shank 28 of the sole 17, mounting by the second and third spikes 16 may be preferred by some golfers.

Through the use of roll bar 19, the foot of the golfer closest to the target for a fairway or tee shot is already canted inwardly as he or she contemplates the shot. The inwardly canted foot tends to produce some flexing inwardly at the knee. That tendency likely will be helpful during the back swing to help the golfer attain a reasonable semblance of the stance or position shown in FIG. 1 when the golf club reaches the top of the swing.

During the swing to impact with the ball, roll bar 19 should preclude the golfer from remaining generally "flat-footed". Following the impact with the ball, the momentum of the body should effect a pivot of the foot closest to the target as the shoe 15 rolls over on the arcuate pivoting surface 20 to generally carry the foot to the phantom line position shown in FIG. 1. It is my belief that the stance and foot action of the foot closest to the target is correctable by use of a roll bar 19 as described to generally provide for greater distance and accuracy and with some consistency for fairway and tee shots to make the game more enjoyable for the user.

Since the height or depth of the roll bar 19 is only in the range of $\frac{3}{8}$ of an inch, relatively little discomfort is experienced when walking with the attachment in place. What little discomfort there is, is far outweighed by the benefit to be derived from its use. Even the sensation derived from the presence of the device, will serve to remind the user relative to its purpose.

Various modes of carrying out the invention are contemplated as being within the scope of the following claims particularly pointing out and distinctly claiming the subject matter which is regarded as the invention.

I claim:

1. In combination with a golf shoe having a plurality of spikes threaded into the sole thereof, an attachment for securement to the shoe of a golfer worn on the foot that will assume the stance position closest to the target when addressing the ball, said attachment comprising a roll bar disposed beneath the sole of the shoe and spaced outwardly from the spikes adjacent to the outside edge of the shoe, said roll bar having an arcuate surface sloping toward said outside edge upon which the golfer can pivot following an impact with the ball and during the subsequent follow-through of the golf swing, a pair of linkage members attached to the roll bar and connected to corresponding spikes, said linkage members being pivotally connected to the roll bar to accommodate varying distances between the corresponding spikes as likely presented on different shoes.

2. In combination with a golf shoe having a plurality of spikes threaded into the sole thereof, an attachment for securement to the shoe of a golfer worn on the foot that will assume the stance position closest to the target when addressing the ball, said attachment comprising a roll bar disposed beneath the sole of the shoe and spaced outwardly from the spikes adjacent to the outside edge of the shoe, said roll bar having an arcuate surface sloping toward said outside edge upon which the golfer can pivot following an impact with the ball and during the subsequent follow-through of the golf swing, a pair of linkage members attached to the roll bar and connected to corresponding spikes, said linkage members being provided with longitudinally extending slots remote from the roll bar, said slots being provided to accommodate distance variations between the spikes and the edge of the sole of the shoe as likely presented on different shoes.

* * * * *